US008385761B2

(12) United States Patent
Higa

(10) Patent No.: US 8,385,761 B2
(45) Date of Patent: Feb. 26, 2013

(54) IMAGE FORMING APPARATUS THAT ADJUSTS A SECONDARY TRANSFER CONDITION FOR A SECONDARY TRANSFER DEVICE BASED ON A DEGRADATION OF TONER

(75) Inventor: Takuma Higa, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 293 days.

(21) Appl. No.: 12/904,425

(22) Filed: Oct. 14, 2010

(65) Prior Publication Data

US 2011/0110676 A1 May 12, 2011

(30) Foreign Application Priority Data

Nov. 12, 2009 (JP) ..... 2009-259174

(51) Int. Cl.
*G03G 15/00* (2006.01)
*G03G 15/16* (2006.01)

(52) U.S. Cl. ..... 399/49; 399/66; 399/302

(58) Field of Classification Search ..... 399/29, 399/49, 66, 302, 314
See application file for complete search history.

(56) References Cited

U.S. PATENT DOCUMENTS 6,564,021 B1 * 5/2003 Nakai et al. ..... 399/49
7,292,798 B2 * 11/2007 Furukawa et al. ..... 399/49
7,444,090 B2 * 10/2008 Nishida et al. ..... 399/49
8,041,243 B2 * 10/2011 Matsushita et al. ..... 399/66
8,165,481 B2 * 4/2012 Iimura ..... 399/29
2010/0080576 A1 4/2010 Nakayama et al.

FOREIGN PATENT DOCUMENTS

| | | | |
|---|---|---|---|
| JP | 2006-171788 | | 6/2006 |
| JP | 2007-101980 | | 4/2007 |
| JP | 2007-286382 | | 11/2007 |
| JP | 4109950 | | 4/2008 |
| JP | 4110190 | | 4/2008 |
| JP | 2008102356 | A * | 5/2008 |
| JP | 2009230003 | A * | 10/2009 |

* cited by examiner

*Primary Examiner* — Robert Beatty
(74) *Attorney, Agent, or Firm* — Oblon, Spivak, McClelland, Maier & Neustadt, L.L.P.

(57) ABSTRACT

An image forming apparatus includes an image bearing member, a toner image forming device, an intermediate transfer member, a primary transfer device, a toner adherence detector, a secondary transfer device, and a controller. The toner image forming device forms a toner image and a toner pattern for detection of degradation of toner on the image bearing member. The primary transfer device transfers the toner pattern onto the intermediate transfer member with transfer conditions that deliberately reduce transfer efficiency compared with that for image formation. The toner adherence detector detects an amount of toner adhered to the toner pattern at multiple places. The controller calculates a degree of degradation of toner based on the difference in the amount of toner adhered to the toner pattern detected by the toner adherence detector and adjusts secondary transfer conditions for the secondary transfer device based on the obtained degradation of toner.

12 Claims, 11 Drawing Sheets

IMAGE FORMING APPARATUS THAT ADJUSTS A SECONDARY TRANSFER CONDITION FOR A SECONDARY TRANSFER DEVICE BASED ON A DEGRADATION OF TONER

CROSS-REFERENCE TO RELATED APPLICATIONS

This patent application is based on and claims priority pursuant to 35 U.S.C. §119 from Japanese Patent Application No. 2009-259174, filed on Nov. 12, 2009 in the Japan Patent Office, which is hereby incorporated herein by reference in its entirety.

BACKGROUND OF THE INVENTION

1. Field of the Invention

Exemplary aspects of the present invention generally relate to an image forming apparatus, such as a copier, a facsimile machine, a printer, or a digital multi-functional system including a combination thereof, and more particularly, to an image forming apparatus that transfers a toner image formed on a photoreceptor to a transfer medium such as a recording medium through an intermediate transfer member.

2. Description of the Background Art

Consistent high-quality imaging for an extended period of time is desired of image forming apparatuses such as copiers, facsimile machines, printers, and so forth. However, in the image forming apparatuses, the toner used to form images is degraded with time, which adversely affects imaging quality.

Typically, in the image forming apparatus, which includes a developing device, an unfixed toner image is developed with a developing agent, for example, a two-component developing agent (hereinafter referred to as a developing agent) consisting of a charged toner and a carrier to form a visible image also known as a toner image. The developing agent is borne by developing agent bearing member, and in order to optimize the amount of the developing agent on the developing agent bearing member, a developing agent regulator or the like is provided to the developing device.

Unfortunately, the toner is subjected to repeated mechanical stress by the developing agent regulator, the practical effect of which is to degrade the toner by causing the charge on the toner to fluctuate undesirably. This complicates efforts to achieve a desirable image density, and also causes contamination of an interior of the device and undesirable toner adherence to recording media sheets.

To address such difficulties, there is known a method for replacing degraded toner with fresh toner when the ratio of degraded toner to total amount of toner reaches a certain level. For example, Japanese Unexamined Patent Application No. 2006-171788 (JP-2006-171788-A) proposes to consume forcibly the toner outside an imaging region when an image area is small and thus a small amount of toner would otherwise be consumed. Degradation of toner is significant with a small amount of toner consumption because the toner is repeatedly stressed. For this reason, the toner is consumed forcibly outside the imaging region to replace the toner with fresh toner.

Disadvantageously, however, the toner is wasted when the toner is consumed forcibly in this approach, thereby increasing operating costs. Moreover, in this approach, when a small amount of toner is anticipated to be consumed, the toner is forcibly replaced with fresh toner. Therefore, the real amount of degraded toner is difficult to determine.

Even when the developing agent contains degraded toner, good imaging quality is still desired of the image forming apparatus. In another approach for achieving high imaging quality for an extended period of time, a process control is performed by measuring an amount of toner adhered to a toner test pattern formed on an image bearing member, for example, a photoreceptor. In this approach, a toner pattern is formed on the photoreceptor and then transferred onto an intermediate transfer member. The amount of toner adhered to the toner pattern is detected and taken into account in setting toner image forming conditions, such as a charging condition, a developing condition, and so forth.

This approach is advantageous because the actual amount of toner adhered to the toner pattern is measured and the toner image forming condition is determined based on the actual amount of the adhered toner, making it relatively easy to obtain a proper amount of toner to adhere to a toner image.

However, there is a drawback to this configuration in that degraded toner tends to be difficult to transfer properly. Therefore, even if the proper amount of toner is adhered on the photoreceptor, if the toner image on the photoreceptor contains degraded toner, the amount of toner adhered to the toner image transferred onto the recording medium becomes uneven, thereby reducing imaging quality.

Furthermore, the present inventor has found that a certain relation exists between the degraded toner and a toner transfer efficiency in an image forming apparatus that transfers a toner image formed on a photoreceptor onto a recording medium through an intermediate transfer medium.

Typically, primary transfer conditions for primary image transfer from the photoreceptor to the intermediate transfer medium are optimized such that the primary transfer is performed with a greater tolerance, so that the degraded toner in the toner image on the photoreceptor can still be transferred. In such a primary transfer process, a decrease in a primary transfer efficiency with respect to the intermediate transfer member is not significant, and thus the amount of toner adhered to the toner image is maintained relatively even.

By contrast, in a secondary transfer process in which the toner image is transferred from the intermediate transfer member onto the recording medium, the degree of tolerance is set to be generally low, and the secondary transfer condition is set to achieve a good transfer efficiency with the toner that is not degraded. In such a secondary transfer condition, if the toner image on the intermediate transfer member contains degraded toner, the degraded toner is difficult to transfer, thereby causing undesirable reduction in the secondary transfer efficiency and unevenness in the amount of toner adhered to the toner image formed on the recording medium.

Referring to FIG. 1, there is provided a graph showing a comparison of adherence of toner using a developing agent with fresh toner and using a developing agent with degraded toner.

In FIG. 1, granularity refers to a characteristic value representing uniformity in the amount of toner adhered to the toner image. The good evenness makes the granularity small.

As illustrated in FIG. 1, when the developing agent containing degraded toner is used, the difference in the granularity in the new developing agent containing only an initial toner and the developing agent containing degraded toner is insignificant on the photoreceptor and on the intermediate transfer member. However, the granularity increases when the toner image is transferred onto the recording medium before the toner image is fixed. In other words, after the secondary transfer process, the amount of toner adhered to the toner image becomes uneven when the toner includes degraded toner. As a result, the image quality on the recording medium is undesirably reduced.

In view of the above, the secondary transfer conditions may be set such that a good transfer efficiency is still achieved even when the toner contains degraded toner. In one approach, for example, a relatively large electric current is set for the secondary transfer as the secondary transfer condition, thereby facilitating transfer of degraded toner. However, a large electric current may adversely affect the transfer efficiency relative to normal toner, that is, toner that is not degraded.

Another approach includes increasing a secondary nip pressure as the secondary transfer condition. This approach has also a drawback in that increasing the nip pressure increases mechanical stress, thus causing fluctuation of the speed of sheet transportation and degradation of sheet transportability, again adversely affecting imaging quality.

In view of the above, there is demand for a device that prevents degradation of secondary transfer efficiency caused by degraded toner and provides consistently high imaging quality for an extended period of time.

SUMMARY OF THE INVENTION

In view of the foregoing, in one illustrative embodiment of the present invention, an image forming apparatus includes an image bearing member, a toner image forming device, an intermediate transfer member, a primary transfer device, a toner adherence detector, a secondary transfer device, and a controller. The image bearing member bears a toner image and a toner pattern for detection of toner degradation on a surface thereof. The toner image forming device forms the toner image and the toner pattern on the image bearing member. The intermediate transfer member faces the image bearing member, and the toner image and the toner pattern are transferred from the image bearing member onto the intermediate transfer member. The primary transfer device transfers the toner image from the image bearing member onto the intermediate transfer member, and transfers the toner pattern from the image bearing member to the intermediate transfer member using transfer conditions that deliberately reduce transfer efficiency compared with transfer efficiency at image formation. The toner adherence detector detects an amount of toner adhered to the toner pattern transferred from the image bearing member onto the intermediate transfer member at multiple places. The secondary transfer device transfers the toner image from the intermediate transfer member onto a recording medium. The controller includes a read only memory (ROM), a random access memory (RAM), and a CPU and adjusts one or more toner image forming conditions of the toner image forming device to adhere a proper amount of toner to the toner image formed on the image bearing member. The controller calculates a degree of degradation of toner based on a difference in the amount of toner adhered to the toner pattern formed on the intermediate transfer member detected by the toner adherence detector at multiple places and adjusts a secondary transfer condition for the secondary transfer device based on the calculated degradation of toner adhered to the toner pattern.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
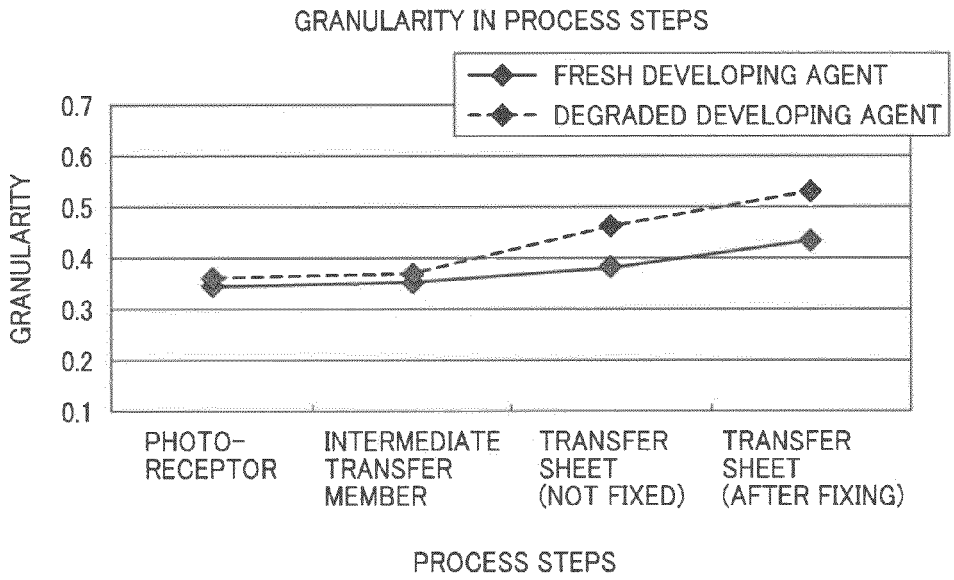
FIG. 1 is a graph showing a comparison between adherence of toner between a developing agent with fresh toner and a developing agent with degraded toner.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Figure 2:
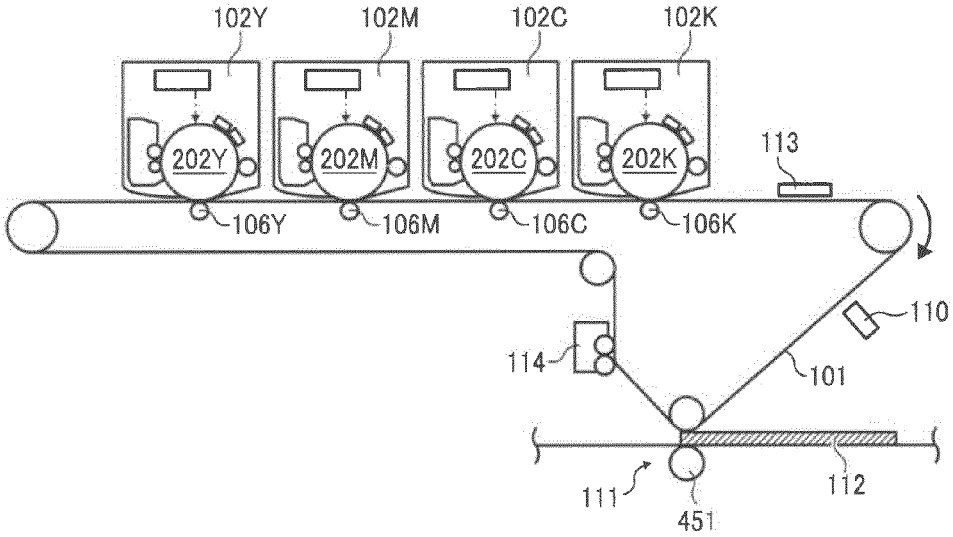
FIG. 2 is a schematic diagram illustrating an electrophotographic printer as example of an image forming apparatus, according to an illustrative embodiment of the present invention.

Referring now to the drawings, wherein like reference numerals designate identical or corresponding parts throughout the several views, and initially to FIG. 2, one example of an image forming apparatus according to an illustrative embodiment of the present invention is described.

FIG. 2 is a schematic diagram illustrating an electrophotographic printer as example of the image forming apparatus according to the illustrative embodiment.

In FIG. 2, the image forming apparatus includes image forming units 102Y, 102M, 102C, and 102K serving as color toner image forming mechanism, an intermediate transfer belt 101, primary transfer devices 106Y, 106M, 106C, and 106K, an image detector 110, a belt cleaner 114, a secondary transfer device 111, and so forth.

The image forming units 102Y, 102M, 102C, and 102K form color toner images of yellow, magenta, cyan, and black, respectively, and are arranged in tandem along the intermediate transfer belt 101 which is wound around and stretched between a plurality of rollers. The image forming units 102Y, 102M, 102C, and 102K also form toner patterns 113 for yellow, magenta, cyan, and black for detection of degradation of toners of yellow, magenta, cyan, and black, respectively. The image forming units 102Y, 102M, 102C, and 102K also form toner patterns for adjustment of charging, writing, and development conditions including adjustment of a developing bias. The intermediate transfer belt 101 moves in a direction of arrow in FIG. 2.

The primary transfer devices 106Y, 106M, 106C, and 106K are arranged in the inner loop of the intermediate transfer belt 101, each facing a respective one of the plurality of the image forming units 102Y, 102M, 102C and 102K, and transfer the toner images as well as the toner patterns of yellow, magenta, cyan, and black formed by the image forming units 102Y, 102M, 102C and 102K onto the intermediate transfer belt 101.

It is to be noted that reference characters Y, M, C, and K denote colors yellow, magenta, cyan, and black, respectively.

The image detector 110 is disposed downstream from the primary transfer devices 106Y, 106M, 106C, and 106K in the direction of movement of the intermediate transfer belt 101, facing the intermediate transfer belt 101. The image detector 110 serves as a toner adherence detector that detects an amount of toner adhered to the toner image as well as the toner pattern transferred onto the intermediate transfer belt 101.

The secondary transfer device 111 is disposed downstream from the image detector 110 and transfers the toner image from the intermediate transfer belt 101 onto a transfer sheet 112 or a recording medium.

The belt cleaner 114 is disposed downstream from the secondary transfer device 111 and cleans residual toner remaining on the intermediate transfer belt 101 after a transfer process.

Figure 3:
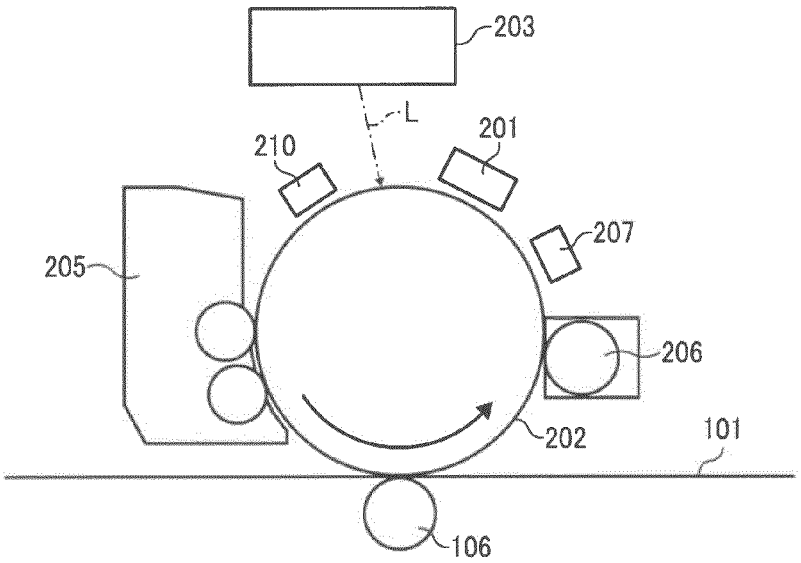
FIG. 3 is a schematic diagram illustrating an image forming unit employed in the image forming apparatus of FIG. 2.

With reference to FIG. 3, a description is now provided of the image forming units 102Y, 102M, 102C and 102K. FIG. 3 is a schematic diagram illustrating the image forming unit 102. It is to be noted that the image forming units 102Y, 102M, 102C and 102K all have the same configuration as all the others, differing only in the color of toner employed. Thus, to simplify the description, the reference characters Y, M, C, and K indicating colors are omitted herein when discrimination therebetween is not required.

In FIG. 3, the image forming unit 102 includes a photoreceptor 202 serving as an image bearing member around which a charging device 201, a writing device 203, a developing device 205, a photoreceptor cleaner 206, a charge eraser 207, and a potential detector 210 are disposed.

The charging device 201 charges the surface of the photoreceptor 202. The writing device 203 serving as an exposure device writes an electrostatic latent image on the surface of the photoreceptor with a write light L. The developing device 205 serves as a developing mechanism that develops the electrostatic latent image with toner. The photoreceptor cleaner 206 cleans residual toner remaining on the photoreceptor 202 after the transfer process. The charge eraser 207 erases the residual charge on the surface of the photoreceptor 202 in preparation for the subsequent image forming operation. The potential detector 210 detects the electric potential.

The charging device 201 is a contactless charging device using a scorotron charger. A grid voltage (charging bias) Vg of the scorotron charger is set to a target charging potential so as to make the potential of the surface of the photoreceptor the target charging potential. According to the illustrative embodiment, the target charging potential is a negative potential.

It is to be noted that the charging device 201 is not limited to that described, and other contactless changing devices or contact charging devices may be used instead.

According to the illustrative embodiment, the writing device 203 employs a laser diode (LD) as a light source that intermittently projects the write light L against the surface of the photoreceptor 202. In other words, the writing device 203 projects repeatedly pulse write light L against the surface of the photoreceptor 202 to form an electrostatic latent image (a dot-electrostatic latent image) per dot.

The amount of toner adhered to the dot-electrostatic latent image is adjusted by changing the exposure time (unit exposure time) upon forming the dot-electrostatic latent image, thereby adjusting gradation of an image. According to the present embodiment, a maximum unit exposure time is divided into 15 parts, thereby enabling gradation adjustment to 16 different degrees (gradations).

It is to be noted that each unit exposure time is hereinafter referred to as an exposure duty. According to the present embodiment, the image can be adjusted to 16 gradations ranging from the exposure duty of 0 (not exposing) to 15 (the maximum unit exposure time).

The developing device 205 includes a developing roller serving as a developing agent bearing member which is disposed opposite the surface of the photoreceptor 202. In the developing device 205, a two-component developing agent including toner particles charged with a predetermined polarity (here, a negative polarity) and magnetic carrier particles is borne on the developing roller to supply the developing agent to the surface of the photoreceptor 202.

The developing roller is supplied with a developing bias Vb, an absolute value of which is greater than a potential VL at an exposure portion and less than a charge potential Vd. Accordingly, in the developing region in which the surface of the photoreceptor 202 faces the developing roller, the toner travels to the electrostatic latent image (exposure portion) on the surface of the photoreceptor 202 while forming an electric field that prevents the toner from moving to a non-exposure portion where no electrostatic latent image is formed. With this configuration, the electrostatic latent image is developed with toner.

When a toner image is formed in the image forming unit 102, first, the charging device 201 charges the surface of the photoreceptor 202 evenly, such that the surface of the photoreceptor 202 has the target charging potential (negative potential). Subsequently, the charged photoreceptor surface is illuminated with the write light L projected from the light source (LD) of the writing unit 203 in accordance with an image data. Accordingly, the potential (absolute value) of the exposure portion of the surface of the photoreceptor 202 is reduced, thereby forming the electrostatic latent image on the surface of the photoreceptor 202.

After that, the electrostatic latent image (in this embodiment, the exposure portion) formed on the surface of the photoreceptor 202 is developed with the toner borne on the developing roller of the developing device 205 into the toner image.

Specifically, the developing bias Vb, the absolute value of which is greater than the potential VL at the exposure portion and less than the charge potential Vd, is applied to the developing roller to enable the toner charged with the predetermined polarity (here, the negative polarity) to adhere electrostatically to the electrostatic latent image. The electrostatic latent image is developed into the toner image.

The toner image formed on the photoreceptor 202 is, then, transferred onto the intermediate transfer belt 101 by the primary transfer device 106. Subsequently, the photoreceptor cleaner 206 cleans and recovers the residual toner remaining on the photoreceptor 202 having not been transferred.

After the toner image is transferred from the photoreceptor drum 202 onto the intermediate transfer belt 101, the charge eraser 207 erases the residual charge on the surface of the photoreceptor 202 by illuminating the photoreceptor drum 202 with neutralization light, thereby eliminating the non-latent image portion. That is, the photoreceptor 202 is neutralized.

As described above, the toner images formed on the photoreceptors 202Y, 202M, 202C, and 202K in the image forming units 102Y, 102M, 102C, and 102K are transferred onto the intermediate transfer belt 101 by the respective primary transfer devices 106Y, 106M, 106C, and 106K.

Referring back to FIG. 2, the secondary transfer device 111 includes a secondary transfer roller 451 serving as a contact member that contacts the intermediate transfer belt 101, thereby sandwiching the transfer sheet 112 therebetween. The secondary transfer roller 451 is applied with a voltage by a power source, not illustrated, so that a predetermined transfer electric current flows between the secondary transfer roller 451 and the intermediate transfer belt 101.

The secondary transfer device 111 transfers the toner image from the intermediate transfer belt 101 onto the transfer sheet 112 by the pressure of the secondary transfer roller 451 and the transfer electric current. At this time, the residual toner having not been transferred onto the transfer sheet 112, thus remaining on the intermediate transfer belt 101, is cleaned and recovered by the belt cleaner 114. Subsequently, a fixing device, not illustrated, fixes the toner image on the transfer sheet 112, thereby completing an image forming cycle.

Figure 4:
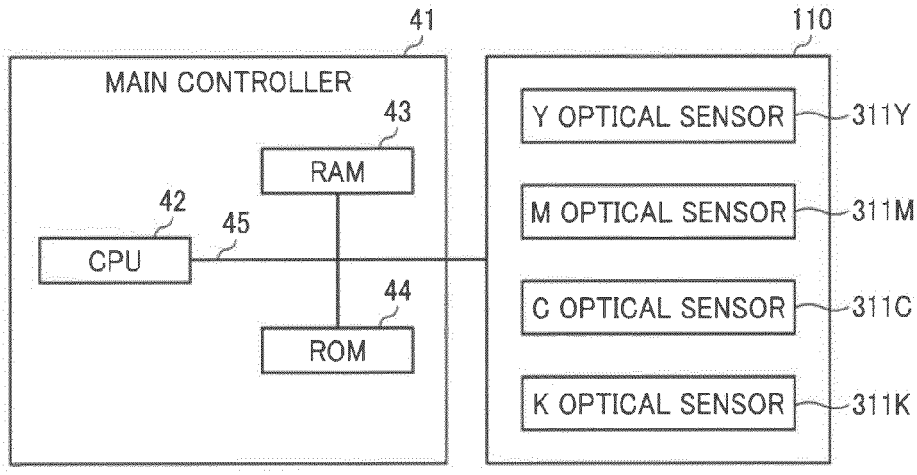
FIG. 4 is a block diagram illustrating electrical connections of components in the image forming apparatus, according to an illustrative embodiment of the present invention.

Referring now to FIG. 4, there is provided a block diagram illustrating electrical connections of components in the image forming apparatus (printer) according to the illustrative embodiment of the present invention.

As illustrated in FIG. 4, the image forming apparatus includes a main controller 41. The main controller 41 drives and controls each component. The main controller 41 includes a central processing unit (CPU) 42, a read only memory (ROM) 44, and a random access memory (RAM) 43, connected to each other trough a bus line 45. The ROM 44 stores fixed data such as a computer program or the like. The RAM 43 serves as a work area that overwritably stores various types of data.

The image detector 110 is connected to the main controller 41. The image detector 110 includes optical detectors 311Y, 311M, 311C, and 311K, each of which serves as a toner adherence detector. The optical detectors 311Y, 311M, 311C, and 311K detect an amount of toners yellow, magenta, cyan, and black adhered to the toner patterns for detection of degradation of toner as well as for adjustment of charging, writing, and developing operations. Information detected by the optical detectors 311Y, 311M, 311C, and 311K is provided to the main controller 41.

Although not illustrated, the charging device 201, the writing device, the developing device 205, and the electric potential detector 210 are also connected to the main controller 41. Based on the amount of toner adhered to the toner patterns formed on the intermediate transfer belt 101, detected by the image detector 110, the main controller 41 controls process conditions such as the developing bias of the developing device 205, the amount of exposure (power of laser, exposure time, and so forth) of the writing device 203, the charging bias of the charging device 201, and so forth.

Figure 5:
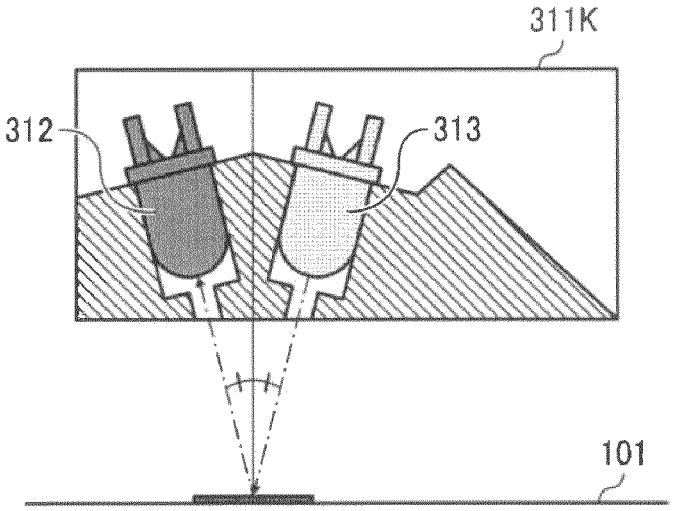
FIG. 5 is a schematic diagram illustrating an optical detector for detecting the amount of black toner, according to an illustrative embodiment of the present invention.
Figure 6:
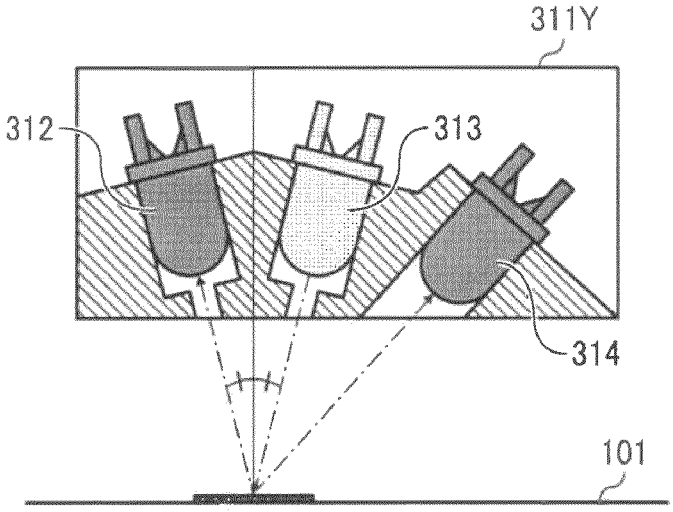
FIG. 6 is a schematic diagram illustrating an optical detector for detecting the amount of yellow toner, according to an illustrative embodiment of the present invention.

With reference to FIGS. 5 and 6, a description is now provided of the optical detector 311 serving as the detector for detecting the amount of toner adhered to the toner pattern according to the illustrative embodiment of the present invention. FIG. 5 is a schematic diagram illustrating the optical detector 311K for detecting the amount of the black toner. FIG. 6 is a schematic diagram illustrating the optical detector 311Y for detecting the amount of the yellow toner.

It is to be noted that the optical detectors 311Y, 311M, and 311C have the same configuration as all the others, differing only in the color of toner to detect. Thus, a description is provided of only the optical detector 311Y as a representative example.

As illustrated in FIG. 5, the optical detector 311K includes a light emitting element 312 and a first light receiving element 313. The light emitting element 312 consists of a light emitting diode (LED) or the like. The first light receiving element 313 receives specular reflection light in the reflected light. The light emitting element 312 projects light onto the intermediate transfer belt 101, which then reflects the light. The first light receiving element 313 receives the specular reflection light among the light reflected by the intermediate transfer belt 101.

By contrast, as illustrated in FIG. 6, the optical detector 311Y for yellow includes the light emitting element 312, the first light receiving element 313, and a second light receiving element 314. The second light receiving element 314 receives diffuse reflection light.

Similar to the light emitting element 312 of the optical detector 311K, the light emitting element 312 of the optical detector 311Y projects light onto the intermediate transfer belt 101, which then reflects the light on the surface thereof. The first light receiving element 313 receives the specular reflection light in the reflected light. The second light receiving element 314 receives the diffuse reflection light in the reflected light.

The optical detector 311K and the optical detector 311Y employ a GaAs infrared emitting diode as the light emitting element 312, with a wavelength of peak emission ($\lambda p$) of 950 nm. A silicon (Si) phototransistor with a peak receiving sensitivity of 800 nm, for example, is employed as the first light receiving element 313 and the second light receiving element 314.

A space of approximately 5 mm is provided between the intermediate transfer belt 101 (target of detection) and each of the optical detectors 311K, 311Y, 311M, and 311C. It is to be noted that the optical detectors 311K, 311Y, 311M, and 311C can be also used as color drift detectors.

According to the illustrative embodiment, the optical detectors 311K, 311Y, 311M, and 311C of the image detector 110 detect the amount of toner adhered on the intermediate transfer belt 101 serving as a toner image bearing member. Based on the amount of toner adherence on the intermediate transfer belt 101, the image forming conditions, such as the charging potential, the amount of exposure, the developing bias, are determined and adjusted.

Figure 7:
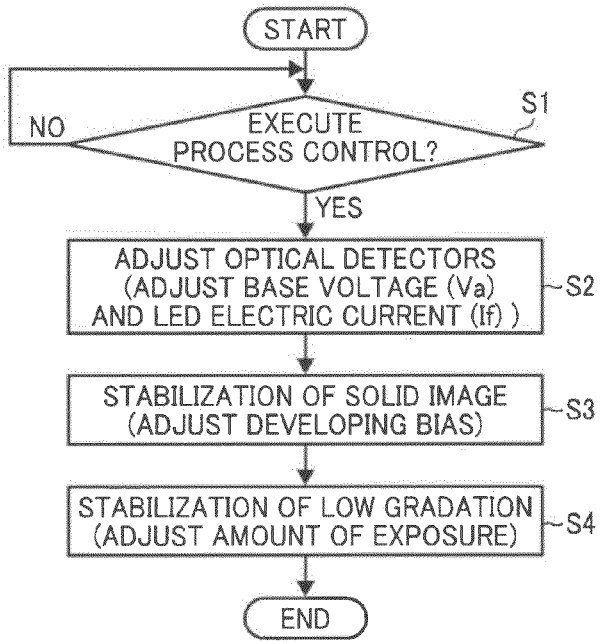
FIG. 7 is a flowchart showing steps in a process of changing image forming conditions (process control), according to an illustrative embodiment of the present invention.

Referring now to FIG. 7, there is provided a flowchart showing steps of changing the image forming condition to achieve optimum imaging quality. Hereafter, this method is referred to as a process control.

When an operating condition of the photoreceptor 202 and the developing device 205, and an environment condition exceed a predetermined threshold value, the main controller 41 executes a process control mode at step S1. After the process control mode is executed, the main controller 41 adjusts an output value of the image detector 110 at step S2.

Figure 8:
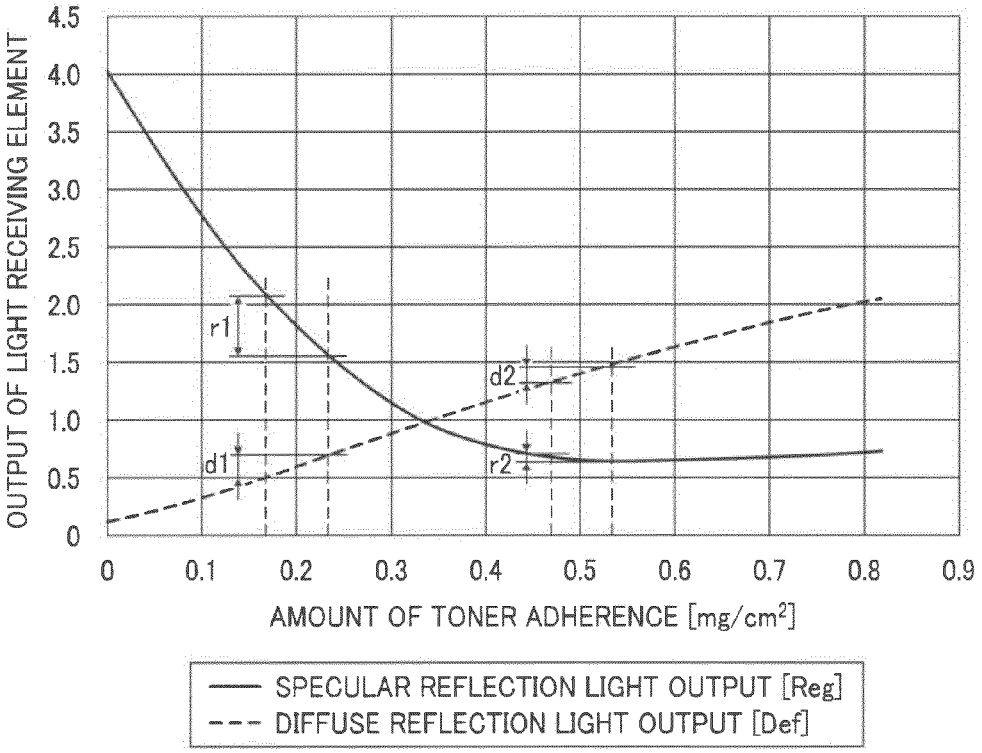
FIG. 8 is a graph showing a relation between an amount of adherence of toner and an output of a first and a second light receiving elements.

With reference to FIG. 8, a description is provided of the adjustment of the image detector 110 in detail. As described above, the image detector 110 including the optical detectors 311K, 311Y, 311M, and 311C is disposed opposite the intermediate transfer belt 101.

FIG. 8 is a graphical representation of a relation between the amount of toner adhered and the output of the first and the second light receiving element. In FIG. 8, the horizontal axis represents an amount of toner adhered to the intermediate transfer belt 101 per unit area. The vertical axis represents an output voltage of the first light receiving element 313 and the second light receiving element 314.

As can be understood from FIG. 8, both the output voltage of the output of the specular reflection light and the diffuse reflection light has a linear characteristic in that, as the amount of adhered toner increases, the output voltage of the output of specular reflection light detected by the first light receiving element 313 decreases gradually. On the other hand, the output voltage of the output of the diffuse reflection light detected by the second light receiving element 314 increases gradually.

The adjustment of the image detector 110 is performed as follows. The intermediate transfer belt 101 is assumed to be a reference plate. The amount of light emission from the light emitting element 312 is adjusted such that the output voltage Vtref of the light receiving element upon detection of the light reflected by the intermediate transfer belt 101 corresponds to the base voltage Vba, while emission of the light emitting element 312 against the intermediate transfer belt 101 is on. The reference voltage Vba has been stored in the ROM 44. The amount of light emission from the light emitting element 312 is adjusted by adjusting the electric current (If) applied to the light emitting element 312.

Referring back to FIG. 7, after adjustment of the output value of the image detector 110 is finished at step S2 (S2), the main controller 41 executes the process control in which a solid image is stabilized at step S3 (S3). In this process control, the developing bias voltage output is changed to different levels while the amount of exposure (laser power) and the charging bias are fixed so that a plurality of toner pattern images each having a different amount of toner adhered thereto is formed. Subsequently, the developing bias voltage is adjusted such that the amount of adhered toner detected by the image detector 110 corresponds to the target value.

After the solid image is stabilized at step S3, the main controller 41 executes the process control with respect to a low gradation at step S4 (S4). In this process control, the amount of exposure (laser power) which is one of the image forming conditions is adjusted.

After the solid image and the low gradation is adjusted, the main controller 41 stores the conditions set in the process control including the charging condition, the developing bias condition, and the laser power condition, in the RAM 43. The process control is finished.

Furthermore, according to the illustrative embodiment, the degree of degradation of toner in the developing agent on the intermediate transfer belt 101 is detected. Based on the degree of degradation of toner, the secondary transfer condition of the secondary transfer device 111 is adjusted.

Figure 9:
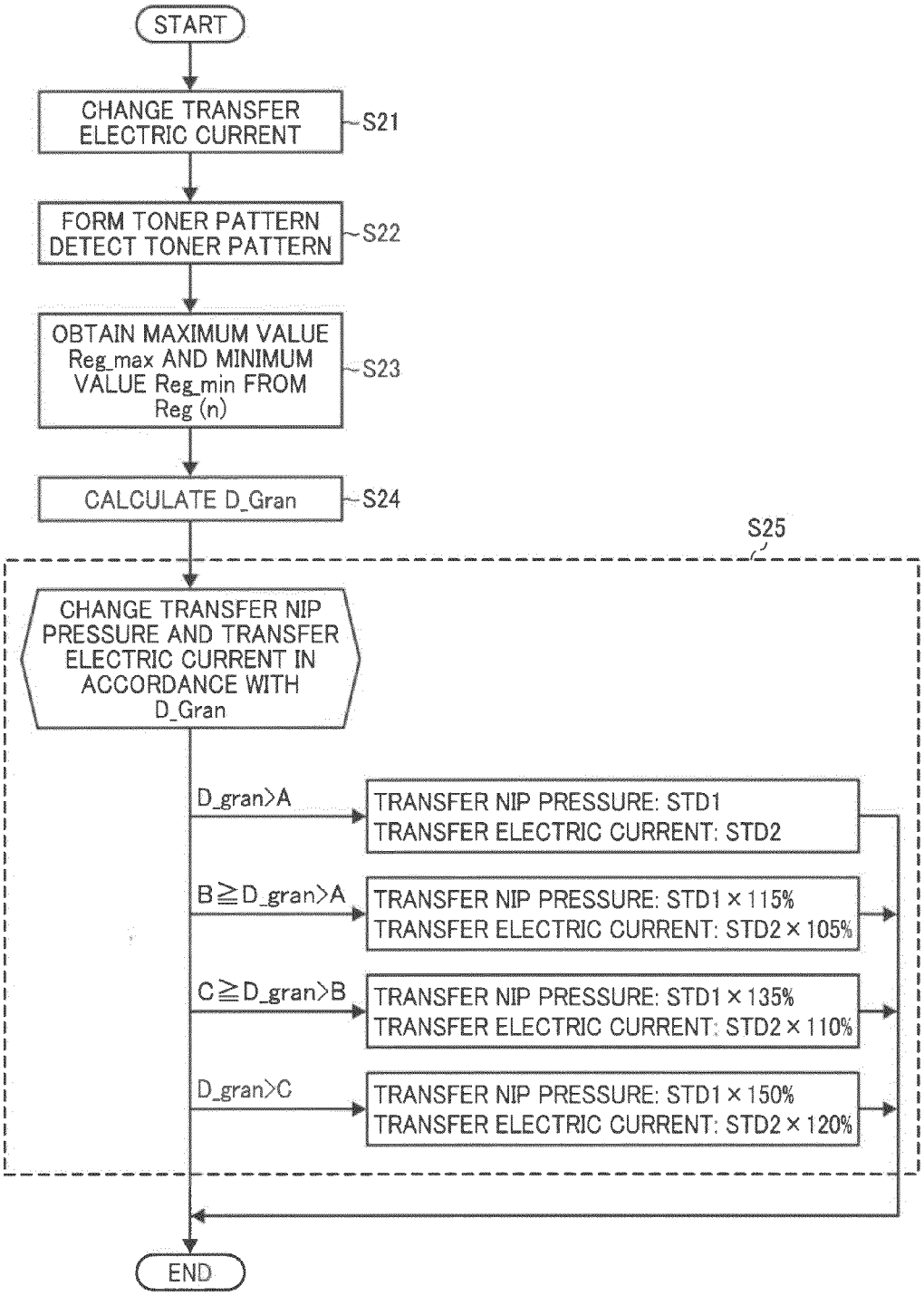
FIG. 9 is a flowchart showing steps of adjustment of a secondary transfer condition by detecting degradation of the black toner, according to the illustrative embodiment of the present invention.

With reference to FIG. 9, a description is now provided of detection of degradation of a black toner in the developing agent for black and adjustment of the secondary transfer condition. FIG. 9 is a flowchart showing steps of adjustment of the secondary transfer condition by detecting degradation of the black toner according to the illustrative embodiment of the present invention.

In this method, the toner pattern for detection of toner degradation is transferred from the photoreceptor 202K onto the intermediate transfer belt 101 under the primary transfer condition for detection. Then, using the optical detector 311K of the image detector 110, the difference in the amount of toner adhered to the transferred black toner pattern is detected, thereby obtaining the degree of degradation of the black toner.

In FIG. 9, at step S21, when the main controller 41 instructs detection of the degree of the toner degradation, the primary transfer electric current for the primary transfer device 106K is changed from the value set at the image formation to the transfer electric current for detection of the toner degradation. The transfer electric current for detection of degradation of toner differs depending on the toner, the developing agent, and the developing device to be used. It is to be noted that the image forming conditions other than the transfer condition have been determined at the process control as described above.

According to the illustrative embodiment, the toner pattern for detection of the toner degradation is transferred onto the intermediate transfer belt 101 at the transfer electric current which is 10% to 50% less than the primary transfer current for the image forming operation.

There are two reasons for changing the primary transfer electric current when transferring the toner pattern for detection of degradation of toner. The first reason is that the optimized primary transfer current includes some margin of transfer so that the degraded toner can still be transferred onto the intermediate transfer belt 101. On the other hand, by reducing the primary transfer current the margin of transfer decreases, thereby deliberately preventing the degraded toner from being transferred onto the intermediate transfer belt 101. As a result, an irregular toner pattern is formed, and the ratio of the degraded toner on the intermediate transfer belt 101 is detected accurately. When the image detector 110 detects such a toner pattern, the obtained value varies.

The second reason is that by reducing the primary transfer electric current, the amount of toner transferred onto the intermediate transfer belt 101 decreases, thereby reducing the amount of toner adhered onto the intermediate transfer belt 101.

Referring back to FIG. 8, the variation "r1" of the output of the specular reflection light substantially near the toner adherence amount 0.2 mg/cm$^2$ is greater than the variation "r2" of the output of the specular reflection light substantially near the toner adherence amount near 0.5 mg/cm$^2$ (r1>r2).

By contrast, in FIG. 8, the variation "d1" of the output of the diffuse reflection light substantially near the toner adherence amount 0.2 mg/cm$^2$ is similar to the variation "d2" of the output of the diffuse reflection light substantially near the toner adherence amount near 0.5 mg/cm$^2$ (d1≈d2). This means that the detection sensitivity for detection of the toner degradation is higher when the output of the specular reflection light is obtained at a substantially low toner adherence.

Referring back to FIG. 9, at step S22, the toner pattern for detection of degradation of toner is formed on the photoreceptor 202K by the image forming unit 102K. The size of the toner pattern for the detection of degradation is, for example, 15 mm in the main scanning direction, and 39 mm in the sub-scanning direction. In the present embodiment, the toner pattern is a solid pattern.

The toner pattern formed on the photoreceptor 202K is transferred onto the intermediate transfer belt 101 by the primary transfer device 106K at the primary transfer electric current for detection of degradation of toner set at step S21. The toner pattern transferred onto the intermediate transfer belt 101 is detected by the optical detector 311K of the image detector 110. When detecting the toner pattern, a sampling interval is approximately 4 msec. Samples of at least 100 points are taken, and a 5-point moving average is obtained so as not to be affected by irregular reflection on the intermediate transfer belt 101.

The optical detector 311K for black in the image detector 110 includes the first light receiving element 312 that receives the specular reflection light. The output of the specular reflection light is received from the first light receiving element 312. In FIG. 9, Reg(n) refers to the output of the first light receiving element 312.

If samples of 100 points are taken and the 5-point moving average is obtained, the following data is obtained: Specular reflection light output data: Reg(1), Reg(2), Reg(20).

Subsequently, at step S23, a maximum value and a minimum value are selected from the specular reflection light output data and stored in the RAM 43. Here, the maximum value is referred to as "Reg_max". The minimum value is referred to as "Reg_min".

At step S24, after the maximum value Reg_max and the minimum value Reg_mim are obtained, the granularity D_Gran is calculated as the degradation of the toner in the developing agent. The granularity D_Gran is obtained by the following equation:

$$D_Gran=\alpha\times(Reg_\max-Reg_\min),$$

where α is a coefficient of determination of the degradation of toner inherent to an image forming apparatus obtained in advance.

With reference to FIGS. 10(*a*) and 10(*b*), a description is now provided of a relation between the adherence of toner pattern on the intermediate transfer belt 101 and the output data Reg(n) of the optical detector 311K for black. FIG. 10A is a schematic diagram for explaining the relation between the adherence of toner pattern on the intermediate transfer belt 101 and the output data Reg(n) of the optical detector 311K for black when the amount of toner adherence is uniform.

Figure 10A:
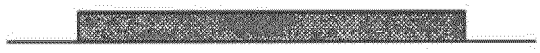
FIG. 10A is a schematic diagram for explaining the relation between adherence of a toner pattern on an intermediate transfer belt of the image forming apparatus and an output data Reg(n) of the optical detector for black when the amount of toner adherence is uniform.
Figure 10A:
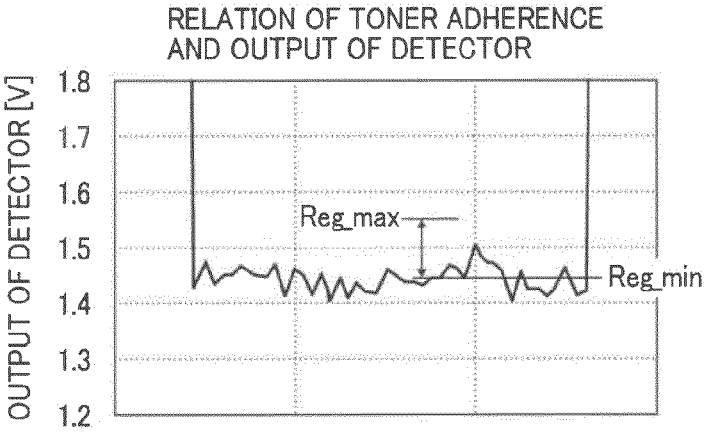
Figure 10B:
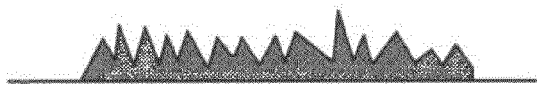
FIG. 10B is a schematic diagram for explaining the relation between adherence of the toner pattern on the intermediate transfer belt and the output data Reg(n) of the optical detector for black when the amount of toner adherence is irregular.
Figure 10B:
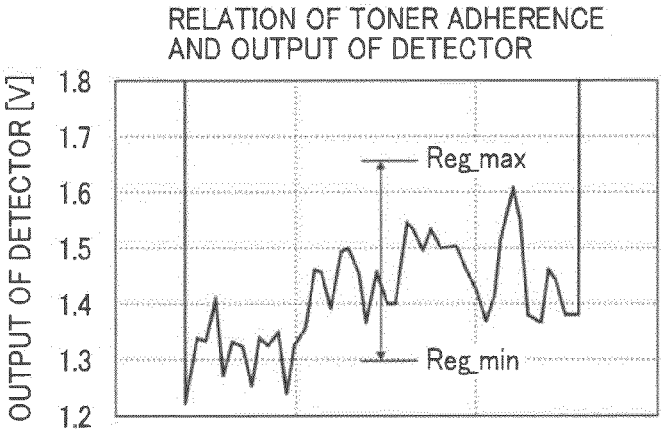

By contrast, FIG. 10B is a schematic diagram for explaining the relation between the adherence of toner pattern on the intermediate transfer belt 101 and the output data Reg(n) of the optical detector 311K for black when the amount of toner adherence is irregular.

In the sampling method of the optical detector 311 described above, if adherence of the toner pattern is uniform, the amount of light that the first light receiving element 312 receives does not vary. Therefore, the difference between Reg_max and Reg_min is relatively small as shown in FIG. 10A.

By contrast, if adherence of toner pattern is not uniform as illustrated in FIG. 10B, the amount of light received by the first light receiving element 312 varies, and the difference between Reg_max and Reg_min increases. Therefore, the granularity D_Gran obtained from Reg_max and Reg_min is used as an indicator for the degree of toner degradation.

It is to be noted that the description has been provided using only the output data Reg(n) because the optical detector 311K for black is used. However, it is the same for the output data from the optical detectors 311Y, 311M, and 311C for color toners.

As described above, in steps S23 and S24, the degree of degradation of toner is obtained.

Subsequently, in step S25, the degree of degradation of toner in the developing agent is evaluated using the value of D_Gran. TABLE 1 shows the pressure in a transfer nip defined by the secondary transfer device and the intermediate transfer belt 111, and the transfer electric current according to values of D_Gran.

In TABLE 1, "A", "B", and "C" are constant numbers of determination of degradation of toner inherent to the image forming apparatus obtained in advance, and have a relation of C>B>A. STD1 refers to an optimum transfer nip pressure in an initial state in which no stress is applied on the toner. STD2 refers to an optimum transfer electric current in the initial state in which no stress is applied to the toner.

TABLE 1

| DEGREE OF TONER DEGRADATION D_Gran | TRANSFER NIP PRESSURE | TRANSFER ELECTRIC CURRENT |
|---|---|---|
| D_Gran > C | STD1 × 150% | STD2 × 120% |
| C >= D_Gran > B | STD1 × 135% | STD2 × 110% |
| B >= D_Gran > A | STD1 × 115% | STD2 × 105% |
| A >= D_Gran | STD1 | STD2 |

In accordance with TABLE 1, the proper transfer nip pressure and the transfer electric current of the secondary transfer device 111 are determined in accordance with the values of D_Gran.

According to the illustrative embodiment, both the transfer nip pressure and the transfer electric current of the secondary transfer device 111 are changed at the same time. Alternatively, however, depending on the degree of degradation of toner, one of the transfer nip pressure and the transfer electric current of the secondary transfer device 111 can be changed.

As described above, at step S25, the secondary transfer condition is adjusted. The degree of degradation of the black toner is detected to adjust the secondary transfer condition when a monochrome image is formed.

Figure 11:
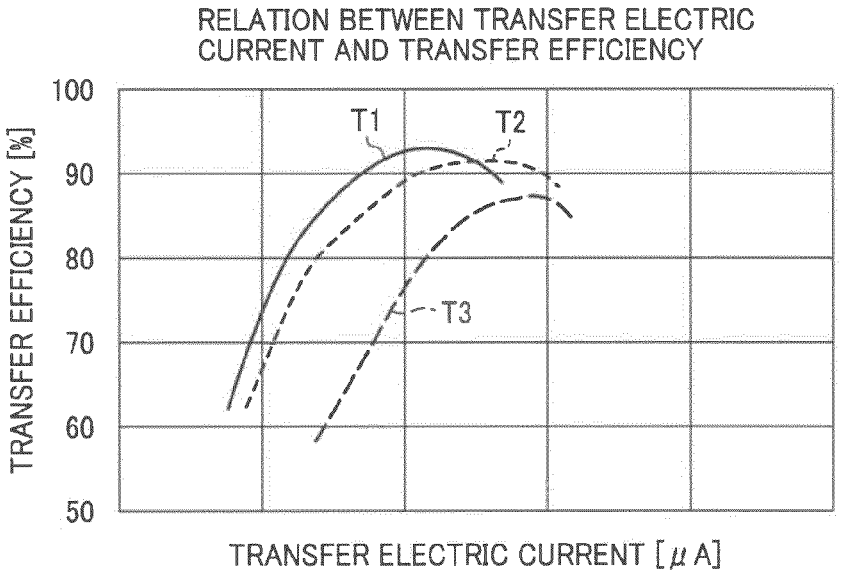
FIG. 11 is a graph showing a relation between a transfer electric current and a transfer efficiency.
Figure 12:
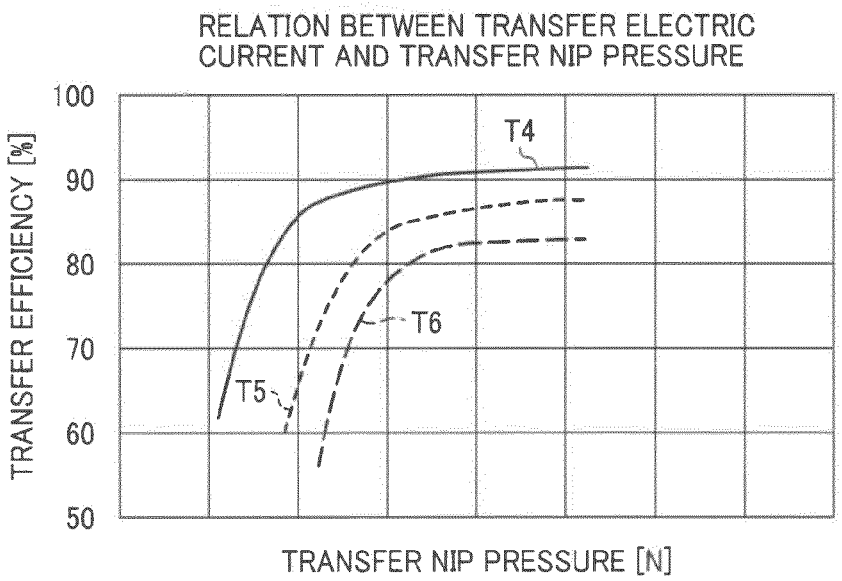
FIG. 12 is a graph showing a relation between a transfer nip pressure and the transfer efficiency.

With reference to FIGS. 11 and 12, the reason for changing the transfer nip pressure and the transfer electric current of the secondary transfer device 111 in accordance with the degree of toner degradation is explained. FIG. 11 is a graph showing a relation between the transfer electric current and the transfer efficiency. FIG. 12 is a graph showing a relation between the transfer nip pressure and the transfer efficiency.

In FIG. 11, T1 represents a toner which is not degraded in the initial state. T2 represents a toner to which stress is applied when the toner is mixed in the developing device for 10 minutes. T3 represents a toner to which stress is applied when the toner is mixed in the developing device for 60 minutes.

The transfer efficiency increases as the transfer electric current is increased. The transfer efficiency reaches its peak at a certain point. If the transfer electric current is increased further from the peak, the transfer efficiency decreases on the contrary.

When the toner is degraded, the maximum transfer efficiency decreases depending on the degree of degradation of the toner. If the degree of degradation is relatively large, the transfer electric current that maximizes the transfer efficiency needs to be increased. In other words, depending on the degree of degradation of toner, the maximum value of the transfer efficiency decreases. If the degree of degradation is relatively large, in order to achieve the maximum transfer efficiency, the transfer electric current that maximizes the transfer efficient needs to be increased. The transfer electric current for achieving a good transfer efficiency differs when the toner is not degraded at the initial state and when the toner is degraded.

In FIG. 12, T4 represents a toner that is not degraded at the initial state. T5 represents a toner to which stress is applied when the toner is mixed in the developing device for 10 minutes. T6 represents a toner to which stress is applied when the toner is mixed in the developing device for 60 minutes. Here, the transfer electric current is set to the current that attains the best transfer efficiency when the toner is not degraded.

As the transfer nip pressure is increased, the transfer efficiency also increases. When the transfer nip pressure reaches a certain value, the transfer efficiency becomes constant.

A good transfer efficiency is achieved with a relatively large transfer nip pressure when using either the toner not degraded in the initial state or the degraded toner. Although a good transfer efficiency is achieved with the large transfer nip pressure, the large transfer nip pressure in the initial state causes mechanical difficulties such as fluctuation of the speed of the intermediate transfer belt 101 and deterioration in transportability of the transfer sheet 102. Thus, it is not desirable to have a relatively large transfer nip pressure from the initial state.

In view of the above, in order to obtain a good secondary transfer efficiency for an extended period of time, the secondary transfer condition is adjusted by detecting the degree of degradation of toner.

Figure 13A:
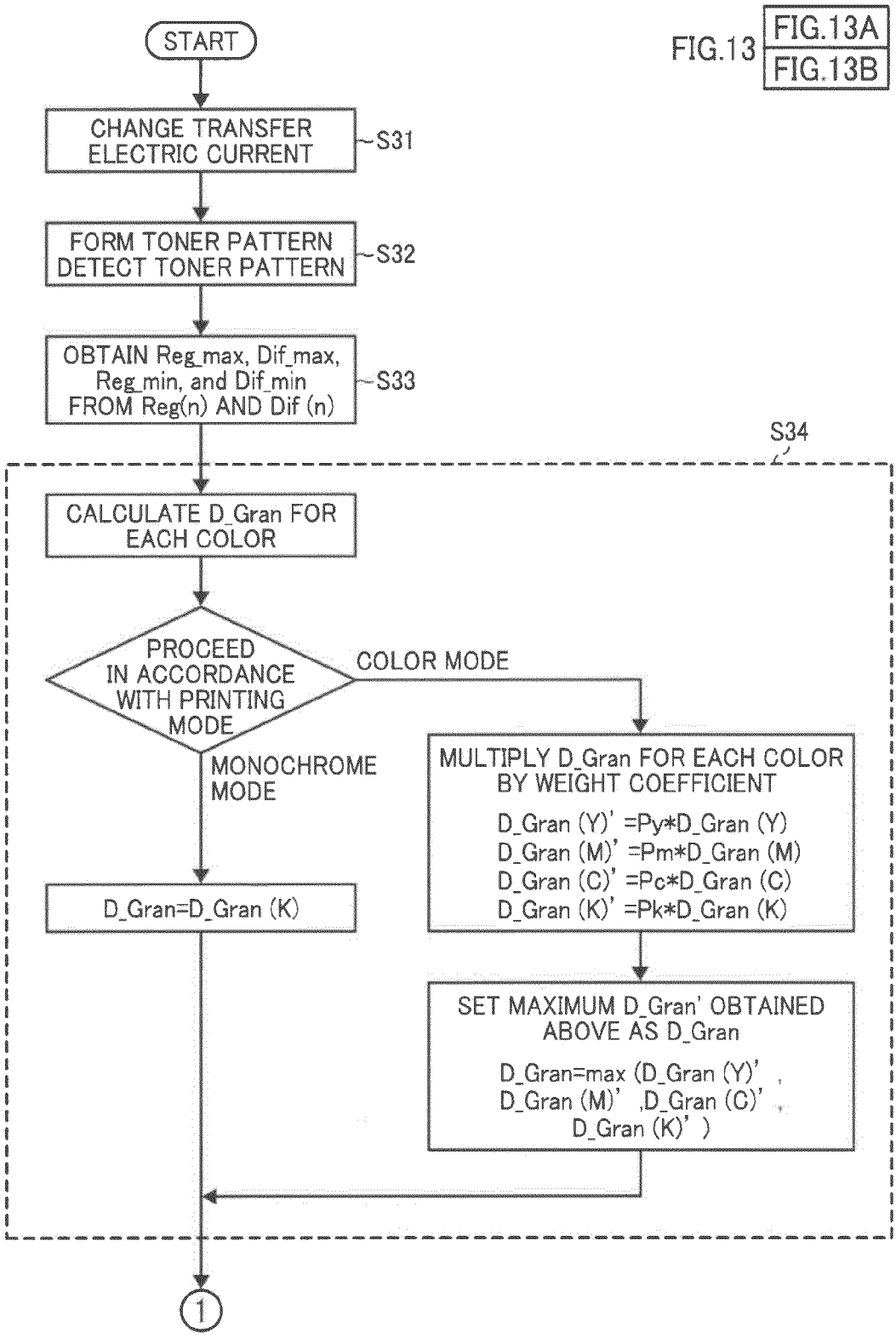
FIG. 13 is a flowchart showing steps in a process of adjustment of the secondary transfer condition by detecting degradation of color toners, according to the illustrative embodiment of the present invention.
Figure 13B:
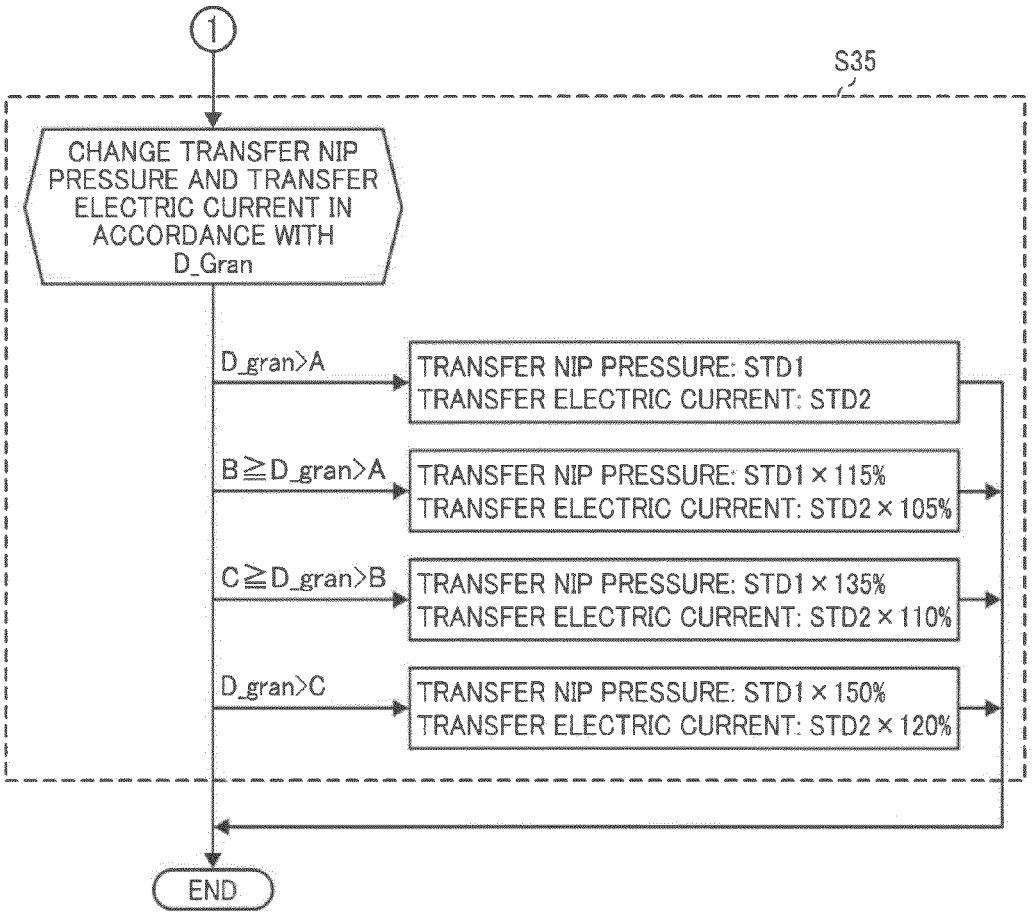

With reference to FIG. 13, a description is now provided of steps of determination of the secondary transfer condition by detecting the degree of degradation of color toners in the color developing agents for producing a color image in addition to the black developing agent. FIG. 13 is a flowchart showing steps of adjustment of the secondary transfer condition by detecting degradation of the color toners according to the illustrative embodiment of the present invention. In FIG. 13, the description of the same step(s) in FIG. 9 is omitted herein.

According to the illustrative embodiment, using the optical detectors 311Y, 311M, 311C, and 311K of the image detector 110, irregularity of toners adhered to the toner patterns transferred from the photoreceptors 202Y, 202M, 202C, and 202K onto the intermediate transfer belt 101 is detected. Based on the irregularity, the degradation of toners is calculated.

In FIG. 13A, at step S31, similar to the step shown in FIG. 9, when the main controller 41 instructs detection of the degree of the toner degradation, the primary transfer electric current for the primary transfer devices 106Y, 106M, 106C, and 106K is changed from the present value to the transfer electric current for detection of the toner degradation. The reason for changing the transfer electric current to the transfer electric current for detection of the toner degradation is explained above.

Subsequently, at step S32, the toner patterns for detection of the toner degradation are formed on the photoreceptors 202Y, 202M, 202C, and 202K. The size of each of the toner patterns is 15 mm in the main scanning direction and 39 mm in the sub-scanning direction. The toner patterns are solid patterns.

The toner patterns formed on the photoreceptors 202Y, 202M, 202C, and 202K are transferred onto the intermediate transfer belt 101 at the primary transfer current for detection of the toner degradation set at step S31. Each of the toner patterns transferred on to the intermediate transfer belt 101 is detected by the respective optical detectors 311Y, 311M, 311C, and 311K. When detecting the toner patterns, a sampling interval is approximately 4 msec. Samples of at least 100 points are taken, and a 5-point moving average is obtained so as not to be affected by irregular reflection on the intermediate transfer belt 101.

Each of the optical detectors 311Y, 311M, and 311C, of the image detector 110 includes the first light receiving element 312 that receives the specular reflection light and the second light receiving element 313 that receives the diffuse reflection light. Here, Reg(n) refers to the output of the first light receiving element 312. Dif(n) refers to the output of the second light receiving element 313.

If the samples of 100 points are taken and the 5-point moving average is obtained, two sets of data are obtained for yellow, magenta, and cyan as follows.

Specular reflection light output data: Reg(1), Reg(2), . . . , Reg(20).

Diffuse reflection output data: Dif(1), Dif(2), . . . , Dif(20).

As explained in FIG. 9, the data of only the output of the specular reflection light is obtained from the optical detector 311K for black.

Subsequently, at step S33, the maximum value and the minimum value are selected from the specular reflection light output data and the diffuse reflection light output data and stored in the RAM 43. Here, the maximum value for the specular reflection light is referred to as "Reg_max". The maximum value for the diffuse reflection light is referred to as "Dif_max". The minimum value of the specular reflection light is referred to as "Reg_min". The minimum value for the diffuse reflection light is referred to as "Dif_min".

At step S34, after Reg_max, Dif_max, Reg_min, and Dif_min are obtained, the granularity D_Gran is calculated as the degree of degradation of the toners in the developing agents. For colors yellow, magenta, and cyan, the degree of granularity D_Gran is obtained by the following equation:

$$D_Gran=\alpha\times(Reg_\max-Reg_\min)+\beta\times(Dif_\max-Dif_\min),$$

where α and β are coefficients of determination of degradation of toner inherent to an image forming apparatus obtained in advance, and α is greater than β (α>β).

As for black, as explained in FIG. 9, the granularity D_Gran is obtained by:

$$D_Gran=\alpha\times(Reg_\max\times Reg_\min),$$

where α is the coefficient of determination of degradation of the toner inherent to an image forming apparatus obtained in advance.

The obtained degree of toner degradation for the toners of yellow, magenta, cyan, and black is expressed as D_Gran (Y), D_Gran (M), D_Gran (C), and D_Gran (K), respectively. When forming a color image, a product of D_Gran for each color multiplied by a coefficient of weight P is calculated. The equations for each color are as follows.

$$D_Gran(Y)'=Py\times D_Gran(Y)$$

$$D_Gran(M)'=Pm\times D_Gran(M)$$

$$D_Gran(C)'=Pc\times D_Gran(C)$$

$$D_Gran(K)'=Pk\times D_Gran(K)$$

Here, the coefficient of weight P is obtained from the granularity of each image in a certain toner degradation state.

Figure 14:
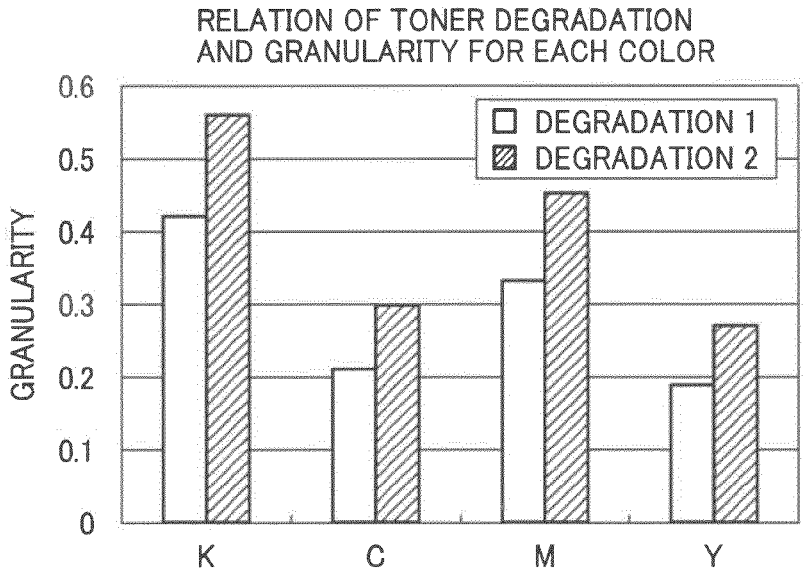
FIG. 14 is a graph showing a relation between a degree of granularity and degradation of toners of each color.

Referring now to FIG. 14, there is provided a graph showing a relation between a degree of granularity of each color and the degradation of toners of each color.

As shown in FIG. 14, even when the degradation state of toners is the same for all colors, the granularity differs for each color. Thus, in order to compensate the difference, the degree of toner degradation D_Gran is multiplied by the weight coefficient P. The weight coefficient P is a relative value between toners of each color. For example, where the weight coefficient of black is 1, the weight coefficient of yellow Py is a value in a range of 0.45 to 0.48, the weight coefficient of cyan Pc is a value in a range of 0.5 to 0.53, and the weight coefficient of magenta Pm is a value in a range of 0.78 to 0.80.

The maximum value D_Gran among D_Gran (Y)', D_Gran (M)' D_Gran (C)' and D_Gran (K)' is employed as the value that determines the secondary transfer condition.

As described above, at steps S33 and S34, the degree of toner degradation is calculated.

Similar to FIG. 9, at step S35 in FIG. 14, the transfer nip pressure and the transfer electric current for the secondary transfer device 111 in accordance with D_Gran are obtained based on TABLE 1.

According to the illustrative embodiment, the transfer nip pressure and the transfer electric current are changed at the same time. Alternatively, depending on the degree of toner degradation, only one of the transfer nip pressure and the transfer electric current of the secondary transfer device 111 is changed.

As described above, at step S35 the secondary transfer condition is adjusted. The degradation of the color toners is detected and the secondary transfer condition is adjusted when the color image forming operation is performed.

As described above, it is preferable to perform the process control first to stabilize the amount of toner adhered to the toner patterns on the intermediate transfer belt 101 and then detect the degree of toner degradation.

Figure 15:
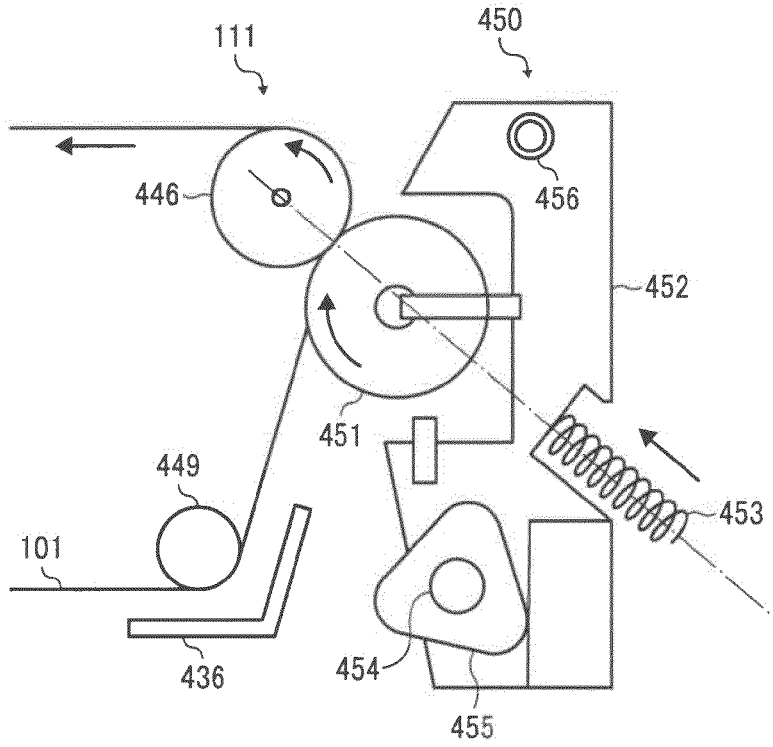
FIG. 15 is an enlarged diagram illustrating a secondary transfer device of the image forming apparatus, according to an illustrative embodiment of the present invention.
Figure 16:
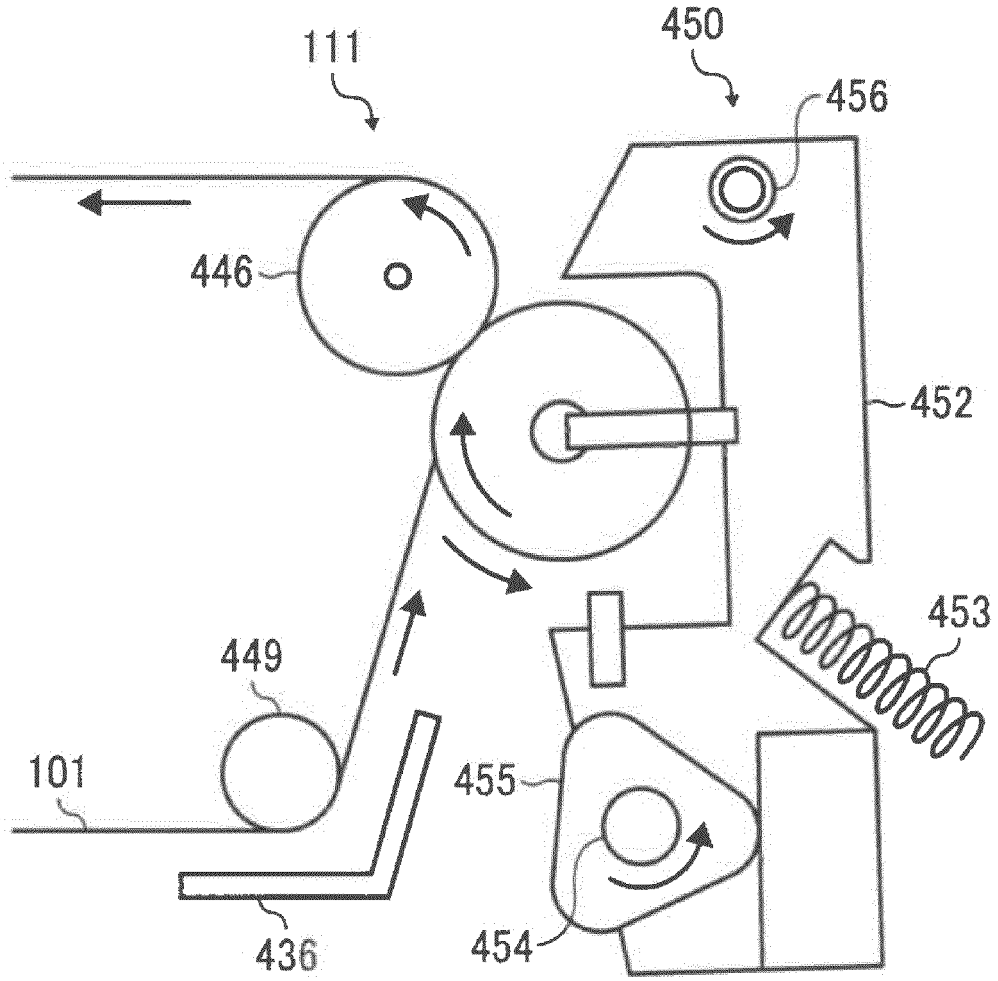
FIG. 16 is an enlarged schematic diagram illustrating the secondary transfer device when the transfer nip pressure of the secondary transfer device is reduced.

Next, with reference to FIGS. 15 and 16, a description is provided of a mechanism that changes the transfer nip pressure of the secondary transfer device 111. FIG. 15 is an enlarged schematic diagram illustrating the secondary transfer device 111 according to the illustrative embodiment. FIG. 16 is an enlarged schematic diagram illustrating the secondary transfer device 11 when the transfer nip pressure of the secondary transfer device is reduced.

In FIG. 15, the secondary transfer device 111 includes a secondary transfer roller unit 450. The secondary transfer roller unit 450 includes a secondary transfer roller 451, a holder 452, a coil spring 453, a cam shaft 454, a cam 455, a holder shaft 456, a cam motor (not illustrated), a cam motor driver (not illustrated), and so forth.

The secondary transfer roller 451 is rotatably held by the holder 452 and applied with a certain voltage by a power source, not illustrated, thereby enabling the transfer electric current to flow between the secondary transfer roller 451 and the intermediate transfer belt 101. The secondary transfer roller 451 and the intermediate transfer belt 101 define the transfer nip portion therebetween.

The holder 452 of the secondary transfer unit 450 is supported by a support member, not illustrated, such that the holder 452 can rotate about the holder shaft 456 provided substantially at the upper portion of the holder 452.

At the side of the holder 452, the coil spring 453 is supported by the support member and urges the holder 452 against the intermediate transfer belt 101. Urged by the coil spring 453, the secondary transfer roller 451 held rotatably by the holder 452 is pressed against and contacts the intermediate transfer belt 101.

The direction of urging by the holder 452 urged by the coil spring 453 is indicated by a dash-dotted line in FIG. 15 on which axial lines of the coil itself, the center of rotation of the secondary transfer roller 451, and the center of rotation of an opposing roller 446 are aligned linearly.

The opposing roller 446 is disposed inside the inner loop of the intermediate transfer belt 101 opposite the secondary transfer roller 451, thereby sandwiching the intermediate transfer belt 101 therebetween and forming a contact unit. The opposing roller 446 is one of rollers around which the intermediate transfer belt 101 is wound.

Substantially near the holder 452, the cam 455 is disposed. The cam 455 is driven to rotate about the cam shaft 454 by the cam motor, not illustrated. The cam surface of the cam 455 contacts the bottom portion of the holder 452, thereby regulating the movement of the holder 452 urged by the coil spring 453 toward the intermediate transfer belt 101.

When the cam motor, not illustrated, operates forward or backward, the cam 455 rotates about the cam shaft 454 which enables the cam surface to approach or separate from the holder 452. With this configuration, the contact position between the cam surface and the bottom portion of the holder 452 moves in the left and the right directions relative to the printer portion, and the holder 452 rotates about the holder shaft 456 in the counterclockwise direction or the clockwise direction by a small about.

Rotation of the holder 452 enables the secondary transfer roller 451 to separate from or approach the intermediate transfer belt 101, thereby reducing or increasing the pressure of the secondary transfer roller 451 relative to the intermediate transfer belt 101. In other words, in the secondary transfer device 111, the holder 452, the coil spring 453, the cam shaft 454, the cam 455, the holder shaft 456, the cam motor, and the controller that controls the cam motor serve as a pressure adjusting mechanism that adjusts pressure of the secondary transfer roller 451 relative to the intermediate transfer belt 101.

When the cam motor is driven forward for a certain time period, the cam 455 rotates about the cam shaft 454 by a predetermined angle in the counterclockwise direction as illustrated in FIG. 16, and presses the bottom portion of the holder 452 from the left to the right side, defeating the urging force of the coil spring 453. Accordingly, the holder 452 rotates about the holder shaft 456 in the counterclockwise direction by a predetermined angle, thereby reducing the pressure of the secondary transfer roller 451 relative to the intermediate transfer belt 101 by a small amount.

On the other hand, when the cam motor is driven backward, the holder 452 rotates about the rotary shaft 456 in the clockwise direction, thereby increasing pressure of the secondary transfer roller 451 relative to the intermediate transfer belt 101.

According to the illustrative embodiment, by changing the pressure of the secondary transfer roller 451 of the secondary transfer device 111 relative to the intermediate transfer belt 101, the transfer efficiency can be increased even when the degraded toner is contained in the developing agent.

Furthermore, by changing the transfer electric current of the secondary transfer device 111, the transfer efficiency can also be increased even when the developing agent contains the degraded toner.

According to the illustrative embodiment, the image forming apparatus includes the image forming unit 102 serving as the toner image forming device for forming the toner image on the photoreceptor 202 serving as the image bearing member, the primary transfer device 106 for transferring the toner image onto the intermediate transfer belt 101 serving as an intermediate transfer member, the secondary transfer device 111 for transferring the toner image from the intermediate transfer belt 101 onto the transfer sheet 112, and the main controller 41 serving as the toner image forming device controller for adjusting conditions for forming the toner image.

In such an image forming apparatus, the toner pattern for detection of the toner degradation is formed on the photoreceptor 202. The toner pattern is transferred onto the intermediate transfer belt 101 under the transfer condition that deliberately decreases the transfer efficiency as compared to the image forming operation. The image detector 110 detects an amount of toner adhered to the toner pattern at multiple locations.

Then, the degree of degradation of toner is calculated based on the variation of the toner adherence detected by the image detector 110. Subsequently, based on the obtained degree of toner degradation, the secondary transfer condition for the secondary transfer device 111 is adjusted.

According to the illustrative embodiment, in order to detect the ratio of the degraded toner in the toner accurately, the toner pattern for detection of the toner degradation is transferred onto the intermediate transfer belt 101 under the primary transfer condition which deliberately reduces the transfer efficiency. Generally, the primary transfer condition at the image formation includes some margin so that the degraded toner can still be transferred.

By contrast, the primary transfer condition for transferring the toner pattern for detection of degradation of the toner is configured such that the transfer efficiency is deliberately reduced, thereby making it difficult to transfer the degraded toner in the toner pattern. The adherence of the toner adhered to the toner pattern on the intermediate transfer belt varies significantly.

The amount of toner adhered to the toner pattern is detected at a plurality of places, and the degree of granularity is quantitatively obtained as the degree of degradation of toner based on the variations of the toner adherence. Accordingly the ratio of degraded toner in the toner is detected accurately.

Based on the degree of degradation of the toner, the secondary transfer condition is adjusted to enable the degraded toner in the toner image formed on the intermediate transfer belt to be transferred. With this configuration, reduction in the secondary transfer efficiency derived from the degraded toner with time can be reduced, if not prevented entirely.

According to the illustrative embodiment, the transfer electric current for the primary transfer device to transfer the toner pattern for detection of degraded toner is 10 to 50% less than the transfer electric current of the image formation. Accordingly, the primary transfer efficiency is deliberately reduced, thereby making it difficult to transfer the degraded toner and thus enabling an accurate detection of the ratio of the degraded toner on the intermediate transfer belt.

According to the illustrative embodiment, the image detector 110 that detects the amount of toner adhered to the toner pattern for detection of the degraded toner may also serve as the detector for detecting the amount of toner adhered to the toner pattern for adjustment of charging, optical writing, and developing conditions. With this configuration, the number of parts employed in the image forming apparatus can be reduced, simplifying its structure.

According to the illustrative embodiment, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member to bear a toner image and a toner pattern for detection of toner degradation on a surface thereof;

a toner image forming device to form the toner image and the toner pattern on the image bearing member;

an intermediate transfer member facing the image bearing member, on which the toner image and the toner pattern are transferred from the image bearing member;

a primary transfer device to transfer the toner image from the image bearing member onto the intermediate transfer member, and transfer the toner pattern from the image bearing member to the intermediate transfer member using transfer conditions that deliberately reduce transfer efficiency compared with transfer efficiency at image formation;

a toner adherence detector to detect an amount of toner adhered to the toner pattern transferred from the image bearing member onto the intermediate transfer member at multiple places;

a secondary transfer device to transfer the toner image from the intermediate transfer member onto a recording medium; and a controller including a read only memory (ROM), a random access memory (RAM), and a CPU to adjust one or more toner image forming conditions of the toner image forming device to adhere a proper amount of toner to the toner image formed on the image bearing member, the controller calculating a degree of degradation of toner based on a difference in the amount of toner adhered to the toner pattern formed on the intermediate transfer member detected by the toner adherence detector at multiple places and adjusting a secondary transfer condition for the secondary transfer device based on the calculated degradation of toner adhered to the toner pattern, wherein the toner adherence detector is an optical detector that detects at multiple places the amount of toner adhered to the toner pattern on the intermediate transfer member based on a specular reflection light output data Reg reflected by the toner pattern when using black toner, and wherein the degree of degradation of toner is obtained using a degree of granularity D_Gran obtained by $D_Gran=\alpha\times(Reg_max-Reg_min)$, where Reg_max is a maximum value of the specular reflection light output data, Reg_min is a minimum value thereof, and $\alpha$ is a coefficient of determination of the degraded toner inherent to the image forming apparatus.

2. The image forming apparatus according to claim 1, wherein the primary transfer device transfers the toner pattern for detection of degradation of toner from the image bearing member to the intermediate transfer member at a transfer electric current that is 10% to 50% less than the transfer electric current used in image formation.

3. The image forming apparatus according to claim 1, wherein the secondary transfer device includes:

a contact device to contact the intermediate transfer member and sandwich the recording medium; and a power source to apply a transfer electric current between the contact device and the intermediate transfer member, the controller controlling the power source to adjust the transfer electric current based on the calculated degree of toner degradation.

4. The image forming apparatus according to claim 1, wherein the toner image forming device forms one or more toner patterns for adjustment of at least one of charging bias, optical writing conditions, and developing bias, and the toner adherence detector detects the amount of toner adhered to the toner patterns.

5. An image forming apparatus, comprising:

an image bearing member to bear a toner image and a toner pattern for detection of toner degradation on a surface thereof;

a toner image forming device to form the toner image and the toner pattern on the image bearing member;

an intermediate transfer member facing the image bearing member, on which the toner image and the toner pattern are transferred from the image bearing member;

a primary transfer device to transfer the toner image from the image bearing member onto the intermediate transfer member, and transfer the toner pattern from the image bearing member to the intermediate transfer member using transfer conditions that deliberately reduce transfer efficiency compared with transfer efficiency at image formation;

a toner adherence detector to detect an amount of toner adhered to the toner pattern transferred from the image bearing member onto the intermediate transfer member at multiple places;

a secondary transfer device to transfer the toner image from the intermediate transfer member onto a recording medium; and a controller including a read only memory (ROM), a random access memory (RAM), and a CPU to adjust one or more toner image forming conditions of the toner image forming device to adhere a proper amount of toner to the toner image formed on the image bearing member, the controller calculating a degree of degradation of toner based on a difference in the amount of toner adhered to the toner pattern formed on the intermediate transfer member detected by the toner adherence detector at multiple places and adjusting a secondary transfer condition for the secondary transfer device based on the calculated degradation of toner adhered to the toner pattern, wherein the toner adherence detector is an optical detector that detects at multiple places the amount of toner adhered to the toner pattern based on specular reflection light output data Reg and diffuse reflection light output data Dif reflected by the toner pattern using color toners, and wherein the degree of degradation of toner is obtained using a degree of granularity D_Gran obtained by the following equation:

$$D_Gran=\alpha\times(Reg_max-Reg_min)+\beta\times(Dif_max-Dif_min),$$

where Reg_max is a maximum value of the specular reflection light output data, Reg_min is a minimum value thereof, Dif_max is a maximum value of the diffuse reflection light output data, Dif_min is a minimum value thereof, and $\alpha$ and $\beta$ which is less than $\alpha$ are coefficients of determination of the degraded toner inherent to the image forming apparatus.

6. The image forming apparatus according to claim 5, wherein the primary transfer device transfers the toner pattern for detection of degradation of toner from the image bearing member to the intermediate transfer member at a transfer electric current that is 10% to 50% less than the transfer electric current used in image formation.

7. The image forming apparatus according to claim 5, wherein the secondary transfer device includes:

a contact device to contact the intermediate transfer member and sandwich the recording medium; and a power source to apply a transfer electric current between the contact device and the intermediate transfer member, the controller controlling the power source to adjust the transfer electric current based on the calculated degree of toner degradation.

8. The image forming apparatus according to claim 5, wherein the toner image forming device forms one or more toner patterns for adjustment of at least one of charging bias, optical writing conditions, and developing bias, and the toner adherence detector detects the amount of toner adhered to the toner patterns.

9. An image forming apparatus, comprising:

an image bearing member to bear a toner image and a toner pattern for detection of toner degradation on a surface thereof;

a toner image forming device to form the toner image and the toner pattern on the image bearing member;

an intermediate transfer member facing the image bearing member, on which the toner image and the toner pattern are transferred from the image bearing member;

a primary transfer device to transfer the toner image from the image bearing member onto the intermediate transfer member, and transfer the toner pattern from the image bearing member to the intermediate transfer member using transfer conditions that deliberately reduce transfer efficiency compared with transfer efficiency at image formation;

a toner adherence detector to detect an amount of toner adhered to the toner pattern transferred from the image bearing member onto the intermediate transfer member at multiple places;

a secondary transfer device to transfer the toner image from the intermediate transfer member onto a recording medium; and a controller including a read only memory (ROM), a random access memory (RAM), and a CPU to adjust one or more toner image forming conditions of the toner image forming device to adhere a proper amount of toner to the toner image formed on the image bearing member, the controller calculating a degree of degradation of toner based on a difference in the amount of toner adhered to the toner pattern formed on the intermediate transfer member detected by the toner adherence detector at multiple places and adjusting a secondary transfer condition for the secondary transfer device based on the calculated degradation of toner adhered to the toner pattern, wherein the secondary transfer device includes:

a contact device to contact the intermediate transfer member and sandwich the recording medium therebetween; and a pressure adjusting mechanism to change a pressure of the contact device pressing against the intermediate transfer member, the controller controlling the pressure adjusting mechanism to adjust the pressure of the contact device pressing against the intermediate transfer member based on the calculated degree of toner degradation.

10. The image forming apparatus according to claim 9, wherein the primary transfer device transfers the toner pattern for detection of degradation of toner from the image bearing member to the intermediate transfer member at a transfer electric current that is 10% to 50% less than the transfer electric current used in image formation.

11. The image forming apparatus according to claim 9, wherein the secondary transfer device further includes:

a power source to apply a transfer electric current between the contact device and the intermediate transfer member, the controller controlling the power source to adjust the transfer electric current based on the calculated degree of toner degradation.

12. The image forming apparatus according to claim 9, wherein the toner image forming device forms one or more toner patterns for adjustment of at least one of charging bias, optical writing conditions, and developing bias, and the toner adherence detector detects the amount of toner adhered to the toner patterns.

* * * * *